US012799558B2

(12) United States Patent
Macedo et al.

(10) Patent No.: US 12,799,558 B2
(45) Date of Patent: Nov. 17, 2026

(54) METHOD FOR PRODUCING PELLETS FIRED IN A PELLETIZING KILN

(71) Applicant: Vale S.A., Botafogo (BR)

(72) Inventors: Francisco de Assis Dutra Macedo, Joinville (BR); Kleiton Gonçalves Lovati, Vitória (BR); Rodrigo Boyer Fernandes, Serra (BR); Yago Morais Zocoli, Vitória (BR)

(73) Assignee: Vale S.A., Rio de Janeiro (BR)

( * ) Notice: Subject to any disclaimer, the term of this patent is extended or adjusted under 35 U.S.C. 154(b) by 497 days.

(21) Appl. No.: 18/280,889

(22) PCT Filed: Feb. 9, 2022

(86) PCT No.: PCT/BR2022/050042

§ 371 (c)(1),
(2) Date: Sep. 7, 2023

(87) PCT Pub. No.: WO2022/187919

PCT Pub. Date: Sep. 15, 2022

(65) Prior Publication Data

US 2024/0295005 A1 Sep. 5, 2024

(30) Foreign Application Priority Data

Mar. 8, 2021 (BR) ..... 102021004299-0

(51) Int. Cl.
*C22B 1/245* (2006.01)

(52) U.S. Cl.
CPC ..... *C22B 1/245* (2013.01)

(58) Field of Classification Search
CPC ..... C22B 1/245
See application file for complete search history.

(56) References Cited

U.S. PATENT DOCUMENTS

| | | | | |
|---|---|---|---|---|
| 3,732,062 A * | 5/1973 | Porteus | C22B 1/16 432/16 |
| 4,181,520 A * | 1/1980 | Reuter | C21B 13/08 75/479 |
| 2020/0032369 A1* | 1/2020 | Strüber | C22B 1/2406 |

FOREIGN PATENT DOCUMENTS

| | | | |
|---|---|---|---|
| BR | 9403502 | A | 9/1996 |
| BR | 102015005373 | A2 | 10/2016 |
| JP | 2017101323 | A | 6/2017 |
| WO | 03052149 | A1 | 6/2003 |
| WO | 2018146183 | A1 | 8/2018 |

OTHER PUBLICATIONS

Golmakani et al., "Simultaneous energy saving and production rate improvement in pelletizing process by solid fuel addition," International Journal of Mineral Processing, 2015, vol. 140, pp. 26-31.

(Continued)

*Primary Examiner* — Christopher S Kessler
(74) *Attorney, Agent, or Firm* — ArentFox Schiff LLP

(57) ABSTRACT

The present invention relates to a pelletizing method. The present invention provides a method for producing pellets fired in a pelletizing kiln, including the steps of providing a bed of green pellets to be fired inside the pelletizing kiln, adding fuel briquettes to the bed of green pellets before firing said pellets inside the pelletizing kiln, and firing the green pellets inside the pelletizing kiln.

8 Claims, 2 Drawing Sheets

(56) References Cited

OTHER PUBLICATIONS

Hou et al., "Application of Intra-Particle Combustion Model for Iron Ore Sintering Bed," Materials Sciences and Applications, Jan. 2011, vol. 2, pp. 370-380.
Machida et al., "Development of the Process for Producing Pre-reduced Agglomerates," JFE Technical Report, May 2009, No. 13, pp. 7-13.
International Search Report and Written Opinion issued in International Patent Application No. PCT/BR2022/050042 on May 9, 2022.

* cited by examiner (estado da técnica)

METHOD FOR PRODUCING PELLETS FIRED IN A PELLETIZING KILN

CROSS REFERENCE TO RELATED APPLICATIONS

The present application is a U.S. national stage of PCT International Patent Application No. PCT/BR2022/050042, filed on Feb. 9, 2022, which claims priority to BR 102021004299-0, filed on Mar. 8, 2021. The contents of the above applications are incorporated herein by reference in their entirety.

FIELD OF THE INVENTION

The present invention is related to ore agglomeration processes. More specifically, the present invention is relating to a pelletizing process.

FUNDAMENTALS OF THE INVENTION

Ore agglomeration operations are intended to give the charges to be fed into blast furnaces or direct reduction furnaces, which consisting basically of iron ores and fluxes (such as silica, alumina, and lime), a suitable shape and mechanical strength appropriate to their downstream path in blast furnaces or direct reduction reactors with percolation of gases through the charge. Briquetting, sintering, and pelletizing stand out among the known agglomeration operations.

Pelletizing is a process that involves obtaining spherical agglomerates with a diameter of around 8-18 mm, which are then called pellets. The pellet formed by rolling iron ore fines into discs or drums is known as raw pellet or green pellet.

The green pellets subsequently receive a heat treatment in the pelletizing furnace at temperatures above 1200° C., thus obtaining the final product, the so-called fired pellet, sintered pellet, or simply "pellet."

The heat treatment, commonly known as firing, takes place in the pelletizing furnace and aims to substantially increase the physical resistance of the green pellets, transforming them into fired pellets by altering the microscopic structure of the iron ore, a phenomenon known as sintering.

For the firing or sintering process in straight-grate furnaces, the green pellets are accommodated in a container known as a grate car, which transports them through the various processing areas of the furnace. The feeding of green pellets is carried out continuously on the grate cars, forming a total layer of pellets called bed of pellets.

The firing of green pellets occurs by heat exchange between the process gases inside the furnace and the bed of pellets. Groups of burners control the temperature of the firing gases through the consumption of fossil fuels (usually fuel oil or natural gas). The connections established between the iron ore grains are directly influenced by the temperature, the time spent by the charge at such temperature, and the nature of the furnace atmosphere.

In general, fossil fuels used in straight-grate furnace burners are expensive and contribute to increased greenhouse gas emissions. In an attempt to overcome this problem, solid carbon can be used inside the green pellets as an additional source of heat, thus contributing to a decreased temperature gradient between the top and bottom of the bed of pellets and, consequently, reducing fuel consumption on the burners. However, the use of carbon inside the green pellets increases fired pellet porosity and, after a certain stage, also reduces its mechanical strength.

The invention herein proposed solves the problems of the state of the art described above in a simple and efficient manner.

SUMMARY OF THE INVENTION

The primary objective of this invention is to provide a process for producing fired pellets in a pelletizing furnace that reduces the temperature gradient in the bed of pellets during the firing process.

The secondary objective of this invention is to provide a process for producing fired pellets in a pelletizing furnace that reduces fuel consumption, especially fossil fuels consumed by the burners, thus reducing greenhouse gas (GHG) emissions.

In order to achieve the aforementioned objectives, this invention provides a process for producing fired pellets in a pelletizing furnace, comprising the steps of (i) providing a bed of green pellets to be fired inside the pelletizing furnace, (ii) adding fuel briquettes to the bed of green pellets before firing them inside the pelletizing furnace, and (iii) firing the green pellets inside the pelletizing furnace.

BRIEF DESCRIPTION OF THE FIGURES

The detailed description below refers to the attached FIGURES and their respective reference numbers.

DETAILED DESCRIPTION OF THE INVENTION

Preliminarily, it is emphasized that the description that follows will start from a preferred embodiment of the invention. However, as will be apparent to those skilled in the art, the invention is not limited to that particular embodiment.

As described above, in short, a process for producing fired pellets in a pelletizing furnace 10 usually comprises the steps of:

(i) providing a bed of green pellets 20 to be fired inside the pelletizing furnace 10; and (ii) firing of the green pellets 20 inside the pelletizing furnace 10.

This invention solves the problems of the state of the art by adding fuel briquette 30 to the bed of green pellets 20 prior to firing them inside the pelletizing furnace 10. Thus, having the fuel briquettes 30 together with the bed of green pellets 20 in the firing process promotes a large release of heat inside the pelletizing furnace 10. In this way, the fuel briquettes 30 cause localized energy to increase when mixed with green pellets 20, reducing nearby pellets and forming "clusters of pellets."

Figure 1:
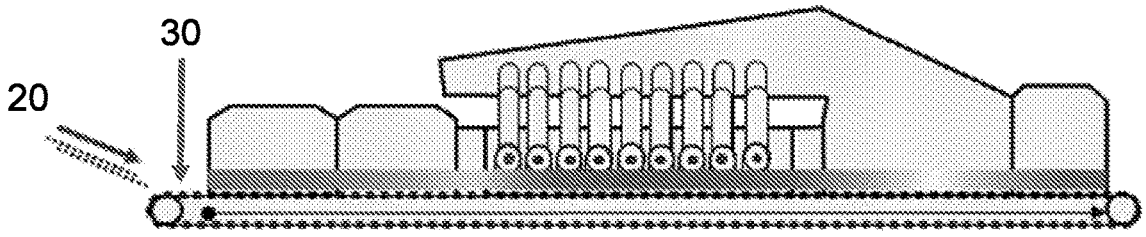
FIG. 1 illustrates a schematic sectional view of a pelletizing furnace wherein the process of the present invention is carried out.
Figure 2:
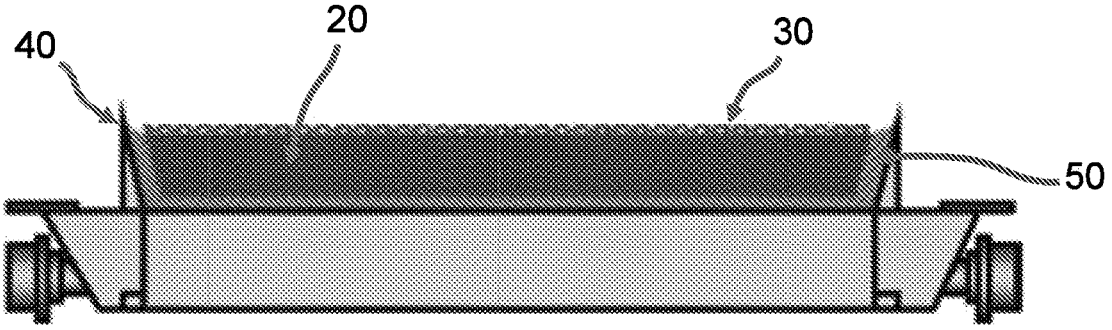
FIG. 2 illustrates a grate car in which a bed of pellets is deposited together with fuel briquettes according to the process of this invention.
Figure 3:
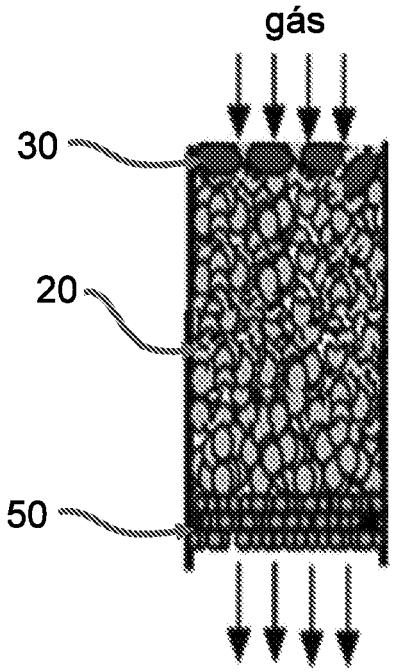
FIG. 3 illustrates the flow of gases through the grate car, on which the bed of pellets and fuel briquettes are located.

Preferably, the fuel briquette 30 is added to the bed of green pellets 20, as shown in FIGS. 2 and 3. In this configuration, the energy released by firing the fuel briquette 30 is transported by the airflow to the entire bed of pellets (see FIG. 3) without causing intense sintering of the pellets in the upper layer of the bed, close to the fuel briquette 30.

As shown in FIG. 2, the green pellets 20 are accommodated in a container known as a grate car 40 which transports them at a certain speed through the various processing zones of the pelletizing furnace 10. Preferably, a lining layer 50 consisting of fired pellets is deposited on the surface of the grate car 40 to protect it against the high temperatures of the firing process. Thus, the green pellets 20 are deposited on the grate car over the lining layer 50, as illustrated in FIGS. 2 and 3.

Preferably, the fuel briquette 30 used may derive from biomass, such as charcoal from corn, charcoal from sugar cane, charcoal from eucalyptus, charcoal from rice husks, among others. In this way, biomass residues are used to carry out the present invention's technique, thus reducing greenhouse gas emissions by not using (or, at least, using lesser amounts) of fossil fuels. Alternatively, the fuel briquette 30 used may be, at least in part, derived from fossil fuels, such as anthracite, mineral coal, green petroleum coke, among others. Due to differences in reactivity and calorific values of each fuel type, the amount of fuel and the intensity of the pellet furnace burners 10 must be adjusted accordingly.

In industrial tests carried out with the use of fuel briquette 30 on the bed of green pellets 20, an improvement of approximately 5% was observed in the physical quality of the pellet produced, in addition to greater homogeneity in the physical quality of the pellets located at the top and bottom of the bed. Thus, the great efficiency of the present invention's process is proved in the reduction of the temperature gradient, which allows for a greater heat transfer to the pellets located at the bottom of the bed.

Additionally, the decreased temperature gradient provided by using the fuel briquette 30 on the green pellets bed 20 causes an acceleration of the pellet firing stage, allowing for increased speed of the grate car inside the pellet furnace 10 and, consequently, higher productivity.

Figure 4A:
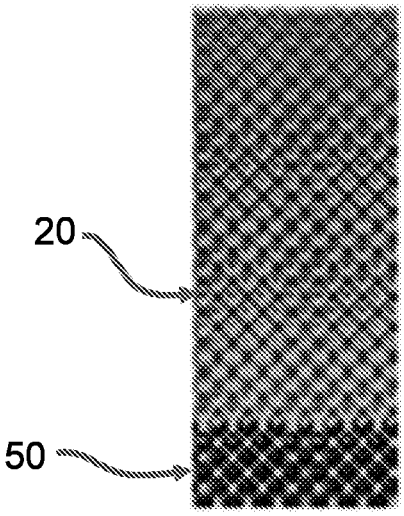
FIGS. 4*a* and 4*b* illustrate the temperature gradients in a bed of pellets during the firing process, as it is currently known in the state of the art and according to the present invention, respectively.
Figure 4B:
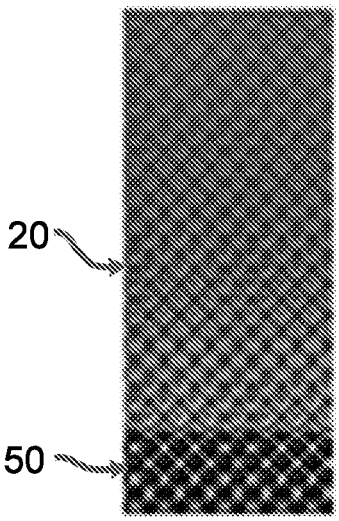

FIG. 4*a* illustrates the temperature gradient in a bed of pellets in the middle of the firing cycle, as it is currently known in the prior art. FIG. 4*b*, in turn, illustrates the temperature gradient in a bed of pellets in the middle of the firing cycle using the process according to the present invention. Therefore, a considerable temperature gradient reduction is observed when applying the process according to the present invention.

The ashes from the firing of the fuel briquette 30 are scorified in the upper part of the bed of pellets, and can be removed through the sieving of the pellets after firing. Additionally, a magnetic separation step after sieving can be used to separate the fired briquette ashes from the fired pellet fine for better use of co-products.

Preferably, the fuel briquette 30 used in the process of the present invention can be of different formats: cylindrical, spherical, cubic, pillow-shaped, among others. Additionally, the fuel briquette 30 used in the process of the present invention can be produced by any fuel agglomeration process, such as briquetting or extrusion.

Preferably, the ash content of the fuel briquette 30 used in the present invention ranges from 5 to 40%.

Preferably, the size of the fuel briquette 30 ranges from 15 to 45 mm. More preferably, the size of the fuel briquette 30 ranges from 15 to 30 mm for those produced from fossil fuel and from 25 to 45 mm for those produced from biomass.

Preferably, the dosage used in the processing of the present invention ranges from 3 to 15 kg of fuel briquette 30 per ton of green pellet 20. More preferably, the dosage employed in the process of the present invention ranges from 6 to 15 kg of fuel briquette 30 per ton of green pellet 20 for fuel briquettes having ash contents of 20 to 40%, and from 3 to 10 kg of fuel briquette 30 per ton of green pellet 20 for those with an ash content of 5 to 20%.

Thus, as explained above, this invention provides a process for producing fired pellets in a pelletizing furnace, which considerably reduces the temperature gradient in the bed of pellets during the firing process. Moreover, the following technical advantages are observed in relation to state-of-the-art pelletizing processes:

(i) reduction of fuel consumption by burners;
(ii) reduction of fuel consumption inside the pellet;
(iii) improved bed permeability;
(iv) improved mechanical strength of the produced pellet;
(v) improved homogeneity in pellet quality;
(vi) increased productivity; and
(vii) reduction of greenhouse gas emissions when using biomass briquettes, making the production process of fired pellets in a pelletizing furnace considerably more sustainable than conventional state-of-the-art processes.

Numerous variations affecting the scope of protection of this application are allowed. Thus, it must be pointed out that this invention is not limited to the particular configurations/embodiments described above.

The invention claimed is:

1. A production process of fired pellets in a pelletizing furnace, comprising:
providing a bed of green pellets to be fired inside the pelletizing furnace;
firing of the green pellets inside the pelletizing furnace, and
adding fuel briquette to the bed of green pellets prior to firing the green pellets inside the pelletizing furnace.

2. The process according to claim 1, wherein the fuel briquette is added onto the bed of green pellets.

3. The process according to claim 1, wherein providing the bed of green pellets is carried out on at least one grate car.

4. The process according to claim 1, wherein the fuel briquette is derived from biomass or partially from fossil fuel.

5. The process according to claim 1, further comprising sieving the pellets after the firing.

6. The process according to claim 1, wherein an ash content of the fuel briquette comprises from 5 to 40%.

7. The process according to claim 1, wherein a size of the fuel briquette comprises from 15 to 45 mm.

8. The process according to claim 1, wherein the pelletizing furnace is a straight-grate furnace.

* * * * *